United States Patent [19]

DeLuca et al.

[11] Patent Number: 5,048,386

[45] Date of Patent: Sep. 17, 1991

[54] FEED MECHANISM FOR FLEXIBLE SHEET MATERIAL DISPENSERS

[75] Inventors: Raymond F. DeLuca, Stamford, Conn.; Paul W. Jespersen, Houston, Tex.; Holger Rasmussen, Kilchberg, Switzerland

[73] Assignee: Georgia-Pacific Corporation, Atlanta, Ga.

[21] Appl. No.: 427,336

[22] Filed: Oct. 27, 1989

[51] Int. Cl.[5] ..... A47K 10/36; B26D 1/56; B26F 3/02

[52] U.S. Cl. ..... 83/37; 83/334; 83/337; 83/649; 83/678; 225/2; 225/96; 225/106

[58] Field of Search ..... 83/334, 335, 337, 338, 83/339, 649, 674, 678, 250–252, 660, 13, 37; 225/96, 106, 2, 4

[56] References Cited

U.S. PATENT DOCUMENTS

| | | | |
|---|---|---|---|
| Re. 28,911 | 7/1976 | Jespersen et al. | 225/96 |
| 454,317 | 6/1891 | Wheeler . | |
| 764,806 | 7/1904 | Ham | 225/96 |
| 1,543,299 | 6/1925 | Shelley | 83/334 |
| 1,975,414 | 10/1934 | Wade | 83/250 X |
| 2,224,572 | 12/1940 | Harvey | 271/2.3 |
| 2,886,226 | 5/1959 | Batlas et al. | 225/106 |
| 3,024,669 | 3/1962 | Creed et al. | 74/821 |
| 3,575,328 | 4/1971 | Jespersen | 225/2 |
| 3,851,810 | 12/1974 | Jespersen | 226/121 |
| 4,122,738 | 10/1978 | Granger | 83/337 X |
| 4,142,431 | 3/1979 | Jespersen | 83/335 |
| 4,206,858 | 6/1980 | DeLuca et al. | 225/96 |
| 4,404,880 | 9/1983 | DeLuca | 83/42 |
| 4,621,755 | 11/1986 | Granger | 225/96 |
| 4,712,461 | 12/1987 | Rasmussen | 83/334 |
| 4,732,306 | 3/1988 | Jesperson | 225/2 |

*Primary Examiner*—Frank T. Yost
*Assistant Examiner*—Eugenia A. Jones
*Attorney, Agent, or Firm*—Banner, Birch, McKie & Beckett

[57] ABSTRACT

A feed mechanism for feeding a web of rolled flexible sheet material, such as soft paper towels, out of a dispenser. The mechanism includes a feed roller within the dispenser and a web cutting blade in the feed roller and projectable and retractable therewith as the feed roller rotates. A contoured cam is attached to an end of the feed roller, and a spring-loaded cam follower presses against the contoured cam. The cam follower, through the cam, controllably assists in the rotation of the feed roller during the feed roller cycle when the blade cuts the web and thereafter to feed a free end of the material to an accessible position outside of the dispenser. The needed maximum pull forces by the user on the material to cut and withdraw the material from the dispenser are thereby significantly minimized, and the likelihood of the soft towel material tearing off in the user's wet hands is accordingly reduced.

15 Claims, 10 Drawing Sheets

FEED MECHANISM FOR FLEXIBLE SHEET MATERIAL DISPENSERS

BACKGROUND OF THE INVENTION

The present invention relates to rolled flexible sheet material dispensers. It particularly relates to those dispensers having sliding cutter rotators disposed within their feed rollers which cut a web of flexible sheet material into individual lengths of material as the web is pulled out of the dispensers, and which dispensers then feed a preselected length of the material from the dispenser accessible to the next user. It further relates to the feed roll mechanisms for such dispensers.

Many designs for dispensers for rolled flexible sheet material, such as paper toweling, are known. Examples thereof are shown in U.S. Pat. Nos. 3,575,328, Re. 28,911, 3,851,810, 4,142,431, 4,206,858, 4,404,880, 4,712,461 and 4,732,306, and copending application, Ser. No. 07/175,255, all of the present assignee. The contents of each of these patents and the '255 application are hereby incorporated by reference in their entireties.

The '461 dispenser, for example, is especially adapted for creped paper toweling where the cutting mechanism is to be actuated solely by the pulling on the paper web and usually by the user's wet hands. A straight sliding knife inside of the feed roller is mounted so that the knife blade follows a path parallel to and offset from the radius of the feed roller. A camming mechanism imparts a reciprocating movement to the blade, as the feed roller is rotated by drawing on the web of material exposed at the dispenser exit. After the blade has cut the web of material and the feed roller rotated further through its cycle the edge of the blade is retracted into the feed roller. Small uncut portions of the web are spaced across the width of the web and with only a minor decrease of pulling force applied by the user the separated uncut portions are torn and the user thereby effectively obtains the appropriate length of toweling. At the same time a free length of web material is provided available and disposed beneath the dispenser exit ready for and accessible to the next user. By exposing a lead length of towel web the next user need not, for sanitary reasons, touch any parts of the dispensers which are often located in public washrooms. Thus, a preselected length of the supply web is severed by a knife as the web is being withdrawn by the user, and a portion of the next sheet is automatically fed outside of the dispenser convenient to the next user.

A number of types of springs, both extension and torsion springs, for drivingly rotating dispenser feed rollers are known. In these known spring designs however, the spring cooperates with an eccentrically mounted pin which is connected with the feed roller, so that the spring is cocked and unloaded only once during each rotation of the feed roller.

Considerable energy is needed to sever the towel web and to automatically feed a portion of the web outside of the dispenser. Where this energy is supplied by the user as he pulls on the towel web with his wet hands, the maximum needed pull must be kept to a minimum to prevent pieces of the wet absorbent toweling from tearing off in the user's fingers. This is especially true for today's softer (less harsh) low-creped paper, such as the Cormatic "Ultima" Towels.

SUMMARY OF THE INVENTION

Accordingly, a principal object of the present invention is to provide an improved dispenser for flexible sheet material.

Another object of the present invention is to provide an improved mechanism for drivingly rotating a feed roller-cutter of a dispenser for a web of flexible sheet material.

A further object of the present invention is to provide an improved dispenser for dispensing preselected lengths of a web of material, which dispenser severs the web as it is being withdrawn therefrom by a user and which subsequently and automatically feeds the remaining free end of the web out the dispenser exit so as to be accessible to the next user.

A still further object of the present invention is to provide a dispenser for dispensing today's weak pliable soft towels without the the towels falling apart as they are pulled from the dispenser by the user's wet hands.

Another object is to provide a dispenser for soft, absorbent sanitary paper toweling wherein the user needs touch only the sanitary toweling, the toweling is cut into properly sized sheets by the dispenser, the soft toweling is unlikely to be torn or pulled apart by the user as he pulls it from the dispenser, and a leading edge of the toweling web is automatically fed from the dispenser for convenient access to the next user.

Directed to achieving these objects, a dispenser for rolls of flexible sheet material, such as sanitary toweling, is herein disclosed. The material web is guided from a roll within a dispenser chassis through a feed roll assembly and out a dispenser exit as the user pulls the web away from the dispenser. The feed roll assembly includes a feed roll having an aperture means, a cutting blade within the feed roll, a cam assembly for projecting the cutting blade out the aperture means as the feed roll rotates to cut the adjacent web and then retracting it fully back into the feed roll, and a drive rotation assist for the feed roll. The drive rotation assist reduces the maximum pull needed to withdraw the toweling from the dispenser and thus the likelihood that the soft toweling will tear as it is being pulled by the user's wet hands.

A contoured cam, a cam follower and a drive spring form the drive rotation assist. The cam is keyed to an end of the drive shaft of the feed roll, and the drive spring forces the cam follower to and along the profile of the cam. The drive spring is cocked and unloaded twice during the cycle of the feed roll thereby driving, or assisting in the rotational drive of, the feed roll when the web is being cut and then later to feed the uncut web outside the dispenser to be accessible for the next user. Thus, the forces needed to cock the feed spring and cut the web do not occur at the same time, and the maximum pull force on the toweling needed during a feed roll cycle is reduced significantly. Instead of the usual cam actuating a spring-loaded cam follower, the present invention thus uses a spring to help actuate a cam. By cocking and unloading the spring at least twice during a single rotation of the feed roller, the spring assists the feed roller at its rotation point where the web is being cut and then later supplies the power for feeding the web outside of the dispenser for the next user.

Other objects and advantages of the present invention will become more apparent to those persons having ordinary skill in the art to which the present invention pertains from the foregoing description taken in conjunction with the accompanying drawings.

DETAILED DESCRIPTION OF PREFERRED EMBODIMENTS OF THE INVENTION

Figure 1:
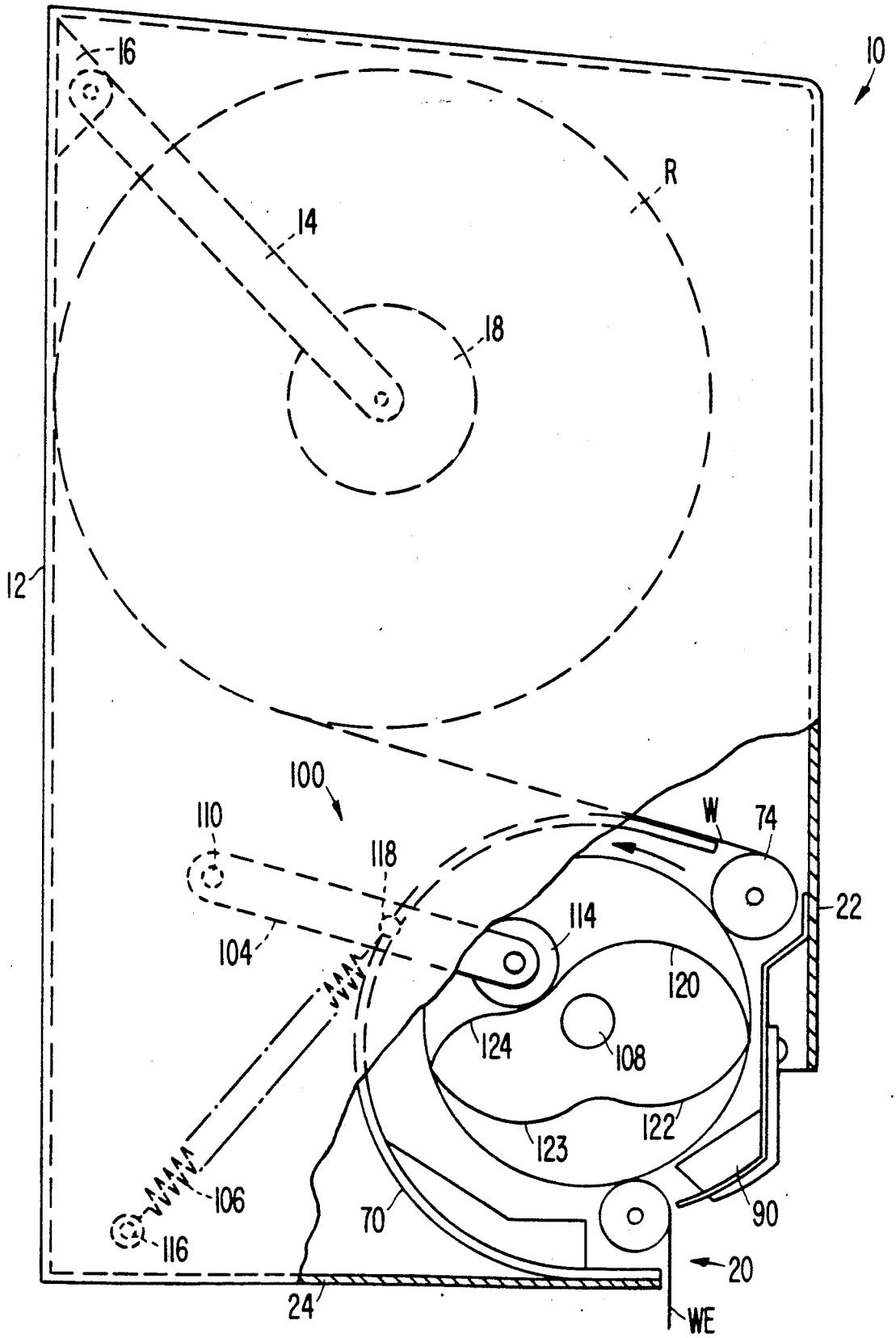
FIG. 1 is a side elevational view with portions thereof in section of a rolled material dispenser of the present invention.

The general outline of a relatively conventional dispenser cabinet chassis 10 which incorporates a feed mechanism of the present invention is illustrated in FIG. 1. The dispenser chassis 10 has a back wall 12 which is provided with appropriate openings (not shown) to accommodate fasteners for attaching the dispenser chassis 10 to a wall. A main supply roll R of flexible sheet material, such as paper toweling, can be suitably supported on a yoke 14 whose legs are pivotally connected to clips 16 fixedly secured to the chassis back wall 12. The legs of yoke 14 each carry a cup 18 at their free ends. These oppositely facing cups 18 enter into the opposite ends of the core of supply roll R such that roll R rests against the back wall 12, moving downwardly as towel material is withdrawn from the roll. This mounting for a supply roll R within a dispenser chassis 10 is conventional in the rolled material dispenser art.

Further, generally well known features for the dispenser chassis 10 can include the front portion consisting of a cabinet cover pivoted to the back wall 12 of chassis 10 to enable the cover to be opened for successive reloading of fresh supply rolls R onto yoke 14. An opening 20 at the lower front portion of chassis 10 defines the dispenser exit as by the front wall 22 of the cover of chassis 10 and terminating above the bottom wall 24 of chassis 10. The web W of flexible sheet material withdrawn off of supply roll R is threaded into the dispensing and cutting mechanism mounted within the chassis 10 which is described in detail below.

Figure 2:
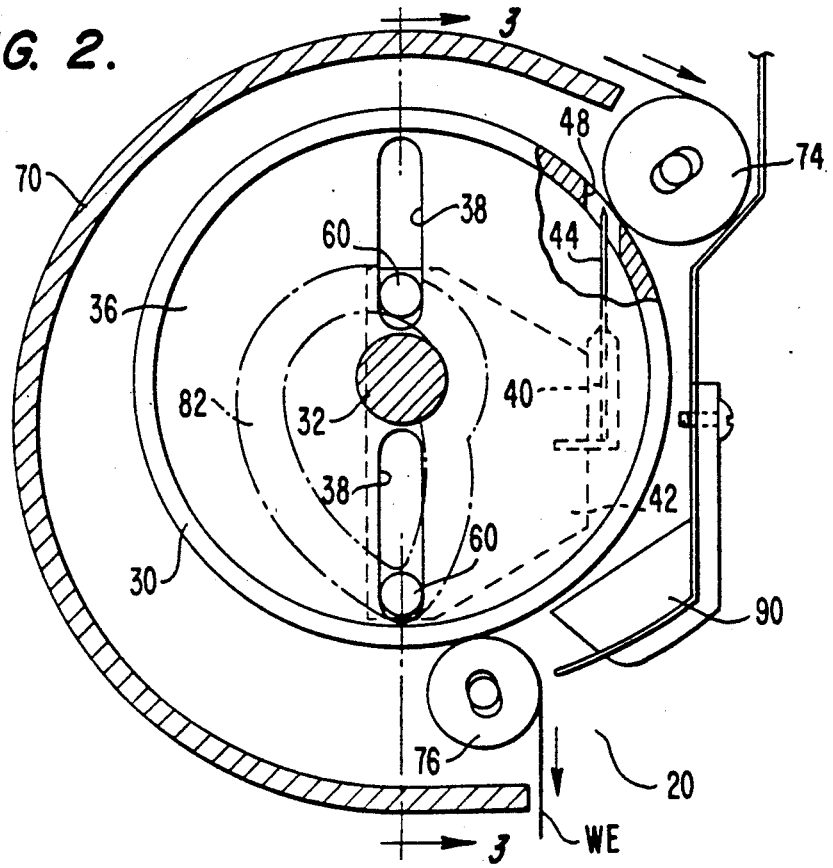
FIG. 2 is an enlarged sectional view of the feed roller and sliding cutter rotator of the dispenser of FIG. 1 with a portion of the feed roller broken away.
Figure 3:
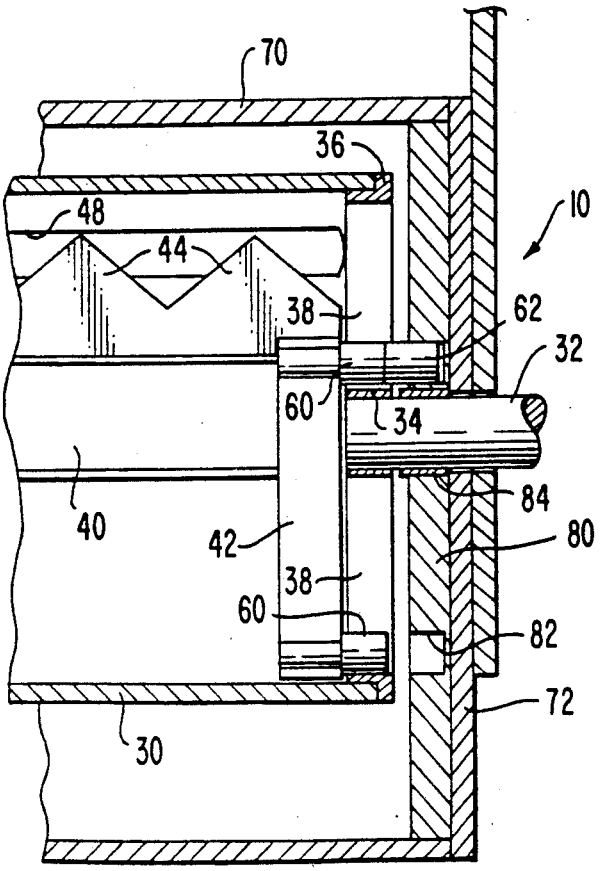
FIG. 3 is a sectional view taken on line 3—3 of FIG. 2.

Referring to FIGS. 1–4, a feed roller 30 of this invention is shown rotatably mounted on stub shafts 32 extending axially outwardly from the opposite ends of feed roller 30. Each stub shaft 32 has one end thereof fixedly securing a central bore 34 in the hub 36 of feed roller 30, and this structure is best shown in FIG. 3. The outer end of one of the stub shafts 32 may be provided with a conventional hand wheel (not shown) fixedly secured thereto to enable manual rotation of the feed roller 30 from a point external to the dispenser chassis 10 should a manual rotation of feed roller 30 be necessary, as when threading the web W of flexible sheet material from supply roll R through the dispensing and cutting mechanism to the dispenser exit 20. Each of the feed roller hubs 36 is formed with a pair of slots 38 aligned along a diameter of the feed roller 30. These pairs of slots in the hubs 36 at the opposite ends of the feed roller 30 form part of the mounting means for the carrier supporting the cutter blade as will be described later.

Figure 6:
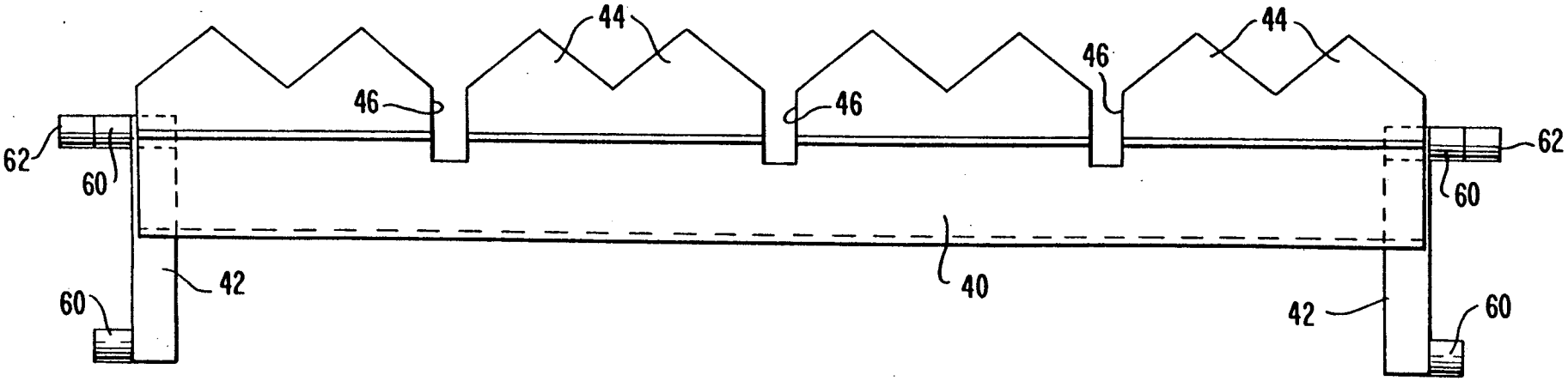
FIG. 6 is an elevational view of the interior cutting blade of the feed roller.

A carrier for cutting blade 40 is provided by a pair of plates 42. One plate 42 is fixedly mounted on each end of the cutting blade 40 and perpendicular to the length of blade 40. As may be best seen in FIG. 6, the blade 40 with the carrier plates 42 at the opposite ends thereof is formed with a series of teeth 44 spaced along the length of the blade. In the illustrated embodiment, four pairs of teeth 44 are provided along the length of blade 40 with these pairs of teeth 44 being separated by recesses 46.

Figure 5:
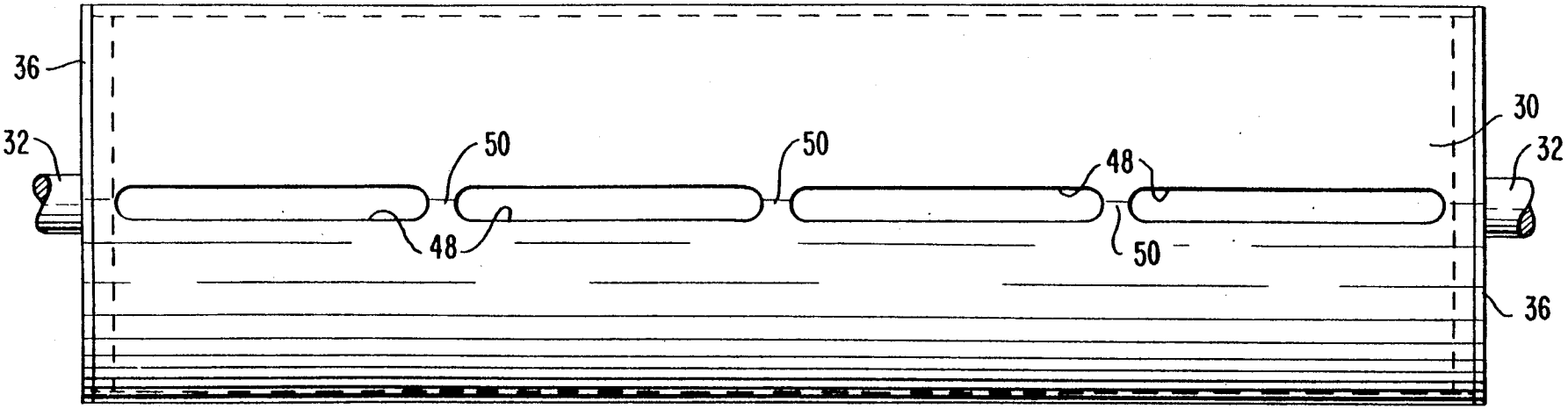
FIG. 5 is a side elevational view of the feed roller of the dispenser of FIG. 1 showing the longitudinal aperture means thereof.

As shown in FIG. 5, the periphery of feed roller 30 is provided with aperture means consisting of a series of longitudinally aligned slots 48. Four of these slots are shown in the embodiment illustrated in FIG. 5 with these slots being separated by continuous surface portions 50 which are part of the peripheral surface of feed roller 30.

In the mounting of cutting blade 40 within feed roller 30, the pairs of teeth 44 on blade 40 separated by recesses 46 project outwardly through the four aligned slots 48 of feed roller 30, and the solid portions 50 of the feed roller periphery pass down into the three recesses 46. By utilizing this cutting blade design with the particular aperture means provided by slots 48 in the periphery of feed roller 30, the cutting action performed on the web of flexible sheet material passing over the feed roller 30 produces a straight line cut parallel with the axis of feed roller 30 and leaves three small uncut portions in the web corresponding to the width of recesses 46 and length of solid portions 50 on the periphery of feed roller 30. By leaving these minor uncut portions of the web W, spaced across the width of the web, the continuity of web W is maintained while the web has been substantially cut but is still within the dispenser chassis 10 before reaching the dispenser exit 20. Once the web is pulled further from the dispenser chassis 10 by the user of the now defined sheet length, a minor degree of pulling force applied by the intending user easily separates the spaced uncut portions left by the configuration of cutting blade 40 and spaced slots 48 in feed roller periphery 30 with the user thereby effectively obtaining the appropriate length of toweling.

Each of the carrier plates 42 fixedly mounted on the opposite ends of cutting blade 40 has a pair of guide pins 60 extending normal to the plane of plate 42. These pins 60 are positioned on each plate 42 to guidingly engage with the aligned slots 38 formed in each hub 36 at the ends of feed roller 30. With this mounting means for the carrier plates 42 fixed to the ends of elongated cutting blade 40, the cutting blade 40 is reciprocable in a path which is parallel to and laterally offset from a radius of the feed roller 30. This radius corresponds to the axis of the aligned slots 38 which extend along a diameter of feed roller 30. Thus, not only does the mounting means enable movement of the cutting blade in a path parallel to and laterally offset from this radius of feed roller 30, but it also provides for reciprocation of the guide pins 60 along this same feed roller radius.

One of the guide pins on each of the carrier plates 42 at the ends of cutting blade 40 has a cam follower 62. This cam follower 62 at each end of feed roller 30 extends outwardly beyond the ends of feed roller 30 as best shown in FIG. 3. Thus, while the guide pins 60 on each carrier plate 42 are essentially enclosed within the pair of aligned slots 38 in the hub 36 at each end of roller 30, the cam follower 62 extends outwardly beyond the feed roller end to engage with a stationary cam mounted on the dispenser chassis, as will be described subsequently.

Within the lower forward portion of dispenser chassis 10 and immediately adjacent the dispenser exit 20, a casing houses the feed roller and other components making up the dispensing and cutting mechanism. The location of this casing within the dispenser chassis 10 is shown in FIG. 1, and its components may generally be seen in the sectional view of FIG. 3. The casing includes a semi-cylindrical housing 70 having an internal diameter somewhat larger than the diameter of feed roller 30. Housing 70 extends from the point where the web W of flexible sheet material enters the dispensing and cutting mechanism, terminating adjacent the dispenser exit 20. The housing 70 extends across the width of the dispenser chassis 10 between the sides of the pivotally mounted cover of dispenser chassis 10. Housing 70 may have its ends closed by end plates 72, one such plate being disposed at each end of housing 70 and appropriately secured thereto in the relation as shown in section in FIG. 3.

Within the casing defined by semi-cylindrical housing 70 and the two end plates 72 closing the ends of such housing is a lead-in pinch roller 74, which is preferably mounted on a shaft and is biased by spring means (not shown) against the peripheral surface of feed roller 30. A second pinch roller 76 is mounted similar to the mounting for pinch roller 74 and is disposed immediately adjacent the dispenser exit 20. Thus, pinch roller 76 will be biased by spring means (not shown) against the peripheral surface of feed roller 30 similar to pinch roller 74.

Figure 4:
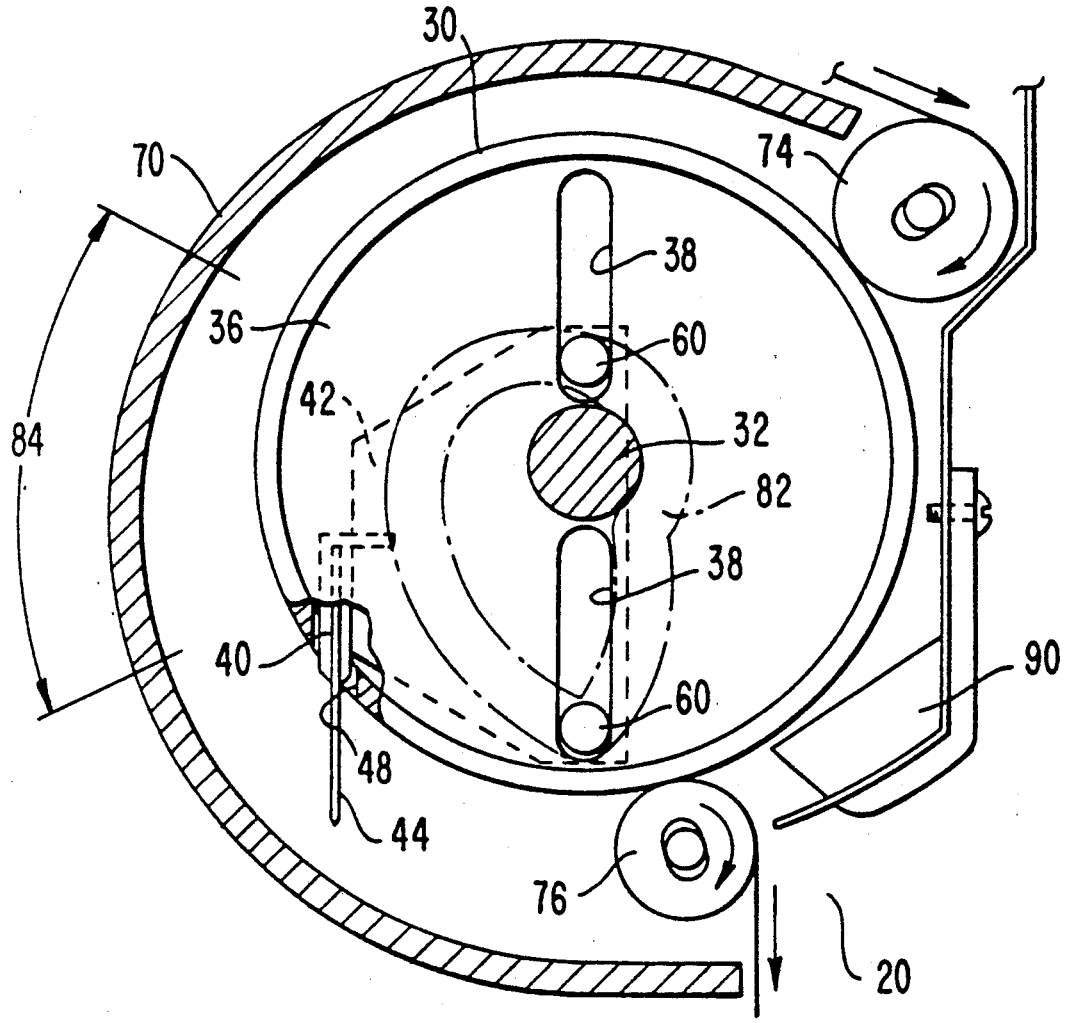
FIG. 4 is a view similar to FIG. 2 showing the feed roller and sliding cutter rotator in a different operating condition.

The path of the web W of flexible sheet material coming from supply roll R as it moves through the dispensing and cutting mechanism will now be described. After leaving roll R carried on pivotally supported yoke 14, the web W initially passes clockwise around the pinch roller 74 as seen in FIGS. 1, 2 and 4. Web W then proceeds counterclockwise around the high friction peripheral surface of feed roller 30. The semi-cylindrical housing 70 which generally concentrically encloses feed roller 30 guides and thereby assists in threading the leading end of web W around the back side of feed roller 30 within dispenser chassis 10. Then the web W passes clockwise over the second pinch roller 76 whereafter the web exits through dispenser exit 20 to be readily available externally of the dispenser chassis 10 for an intending user of the toweling material.

To effect positive reciprocation of the cutting blade 40 and thereby project the cutting teeth 44 forming the cutting edge beyond the periphery of feed roller 30 through the aperture means provided in the feed roller periphery by slots 48 to cut the web and thereafter retract the cutting edge as the feed roller rotates, stationary cams are mounted on the dispenser chassis 10 adjacent the ends of feed roller 30. These stationary cams in the illustrated embodiment are provided by a cam plate 80 having a cam track 82 formed therein. As shown in FIG. 3, the cam plate 80 is disposed within the semi-cylindrical housing 70 and in abutment with the end plate 72. A similar cam plate 80 with similar cam track 82 formed therein is disposed at the opposite end of semi-cylindrical housing 70 and end plate 72 at the other end of feed roller 30. The cam follower 62 disposed in alignment with the guide pin 60 at the upper end of the carrier plate 42 for cutting knife 40 is engaged within the cam track 82 of cam plate 80. The configuration of the cam track 82 is shown by the broken lines showing for the cam track on FIGS. 1, 2 and 4.

To support the feed roller 30 on its stub shafts 32 within the casing provided by housing 70 and end plates 72, each cam plate 80 has a sleeve bearing 84 within which the stub shaft 32 is journaled. Such a structure is shown in FIG. 3, and a similar construction is provided at the opposite end of feed roller 30 and associated cam plate 80.

A stripper bar 90, as shown in FIG. 1, is fixed to the front wall 22 of dispenser chassis 10. This front wall 22 as previously described may be the front of the cover forming a part of the dispenser chassis 10, such cover being pivotally mounted on the chassis back wall 12. The lower end of the stripper bar 90 which extends along the length of feed roller 30 is disposed closely adjacent the peripheral surface of feed roller 30 immediately in front of the exit pinch roller 76. The stripper bar 90 ensures that the web of creped material is stripped from the high friction surface of the feed roller 30 and properly guided down along exit pinch roller 76 to the dispenser exit 20.

It has been described hereinabove how the web of creped material being unwound from supply roll R is threaded clockwise around pinch roller 74, then counterclockwise around the high friction surface of feed roller 30 and then clockwise around exit pinch roller 76. With web W so threaded and the dispensing and cutting mechanism in the position shown in FIGS. 1, 2 and 3, the cutting edge formed by teeth 44 on cutting blade 40 is retracted to lie within the periphery of feed roller 30. The cam follower 62 at the upper location of pin 60 on carrier plate 42 is engaged in the portion of cam track 82 which is closely adjacent to the axis of feed roller 30 defined by the supporting stub shafts 32. By applying a pulling force on web WE, web material withdrawn from supply roll R passes around lead-in pinch roller 74, thence around the high friction surface of feed roller 30 and finally around the exit pinch roller 76 leaving through exit 20 so as to be accessible to the user.

As the web material is pulled out of the dispenser, the feed roller 30 is caused to rotate and the cam followers 62 to then move counterclockwise, as shown in FIGS. 1-3, around the path of cam tracks 82. This continued rotation of feed roller 30 moves the cam followers 62 which were disposed at the uppermost position in cam tracks 82 in FIGS. 1 and 2 until these cam followers have progressed to the lowermost position within cam tracks 82 as shown in FIG. 4. During this one hundred and eighty degree rotation of feed roller 30, the cutting edge on knife 40 provided by teeth 44 progresses from within the periphery of the feed roller 30 to a position where the cutting edges of teeth 44 are fully projected as shown in FIG. 4. Also during this one hundred and eighty degree rotation while the cutting edges of teeth 44 are projected through the aligned slots 48 in the periphery of feed roller 30, the web is substantially cut with only small uncut portions left defined by the recesses 46 in knife 40 cooperating with the solid portions 50 which separate the aligned slots 48. The approximate paper cutting area is designated by area 84 in FIG. 4.

Continued withdrawal of the web material rotates feed roller 30 further, with the cam followers 62 starting to move up within the cam tracks 82 of cam plates 80, thereby rapidly retracting the cutting edges of teeth 44 on cutting blade 40 back within the feed roller 30. When the slots 48 reach the tangent line between feed roller 30 and exit pinch roller 76, the cutting edge teeth 44 of knife 40 are fully retracted back within the feed roller 30. This fully retracted position for knife 40 continues as the cam followers 62 travel along the remaining path of cam tracks 82 and until the slots 48 reach the contact line between feed roller 30 and pinch roller 74. This position is shown for knife 40 in FIGS. 1 and 2.

At this stage, the user can readily separate the three small uncut portions left by recesses 46 in knife 40 to thereby make a predetermined length of creped material available. At the same time, a free length of web end WE is disposed beneath the dispenser exit 20 ready for the next intended user of the towel material. Of course, the above-described procedure in operating and dispensing and cutting mechanism may be repeatedly carried out thereafter to the extent of toweling desired by the user.

It should be noted that due to the laterally offset location of the cutting blade 40 relative to a radius of feed roller 30, the cutting edge of the blade emerges from the interior of the feed roller in the direction of feed roller rotation. The friction coated surface of the feed roller 30 behind the blade cutting edge holds the creped web material thereby minimizing stretch in the towel paper material as the knife penetrates it. A positive cutoff of the web with a minimum travel of the cutting blade is thus possible.

Figure 7:
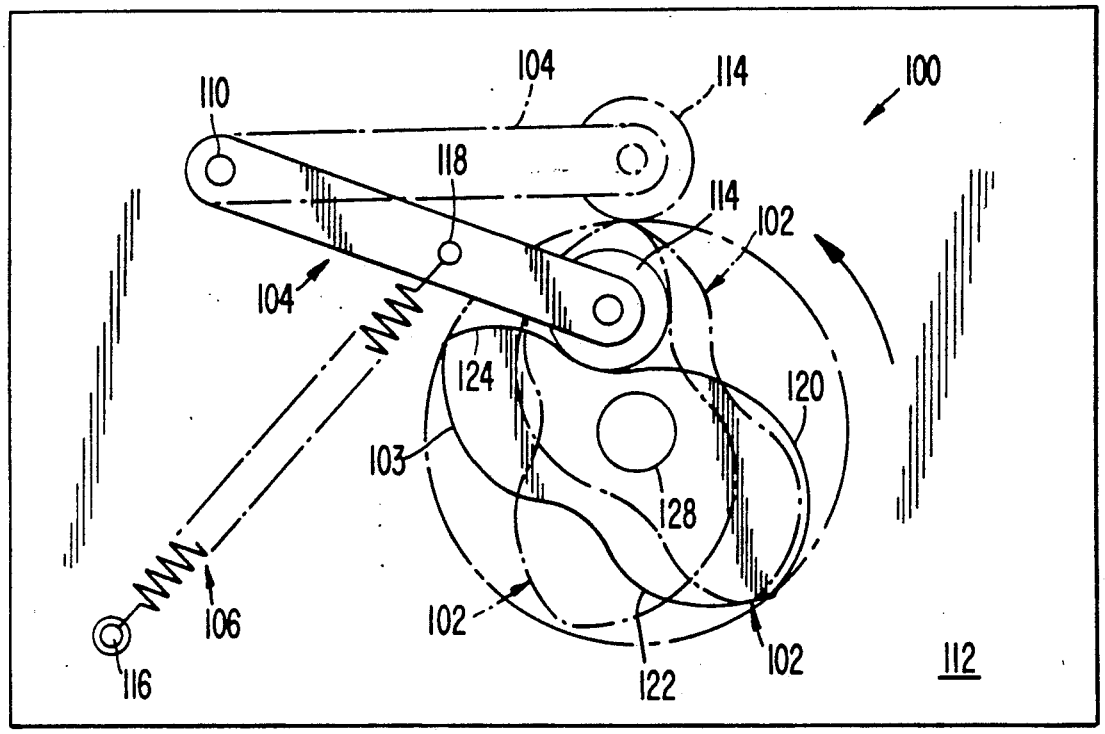
FIG. 7 is a side elevational view of a drive assist assembly, in one position, for the feed roller of FIG. 1.
Figure 8:
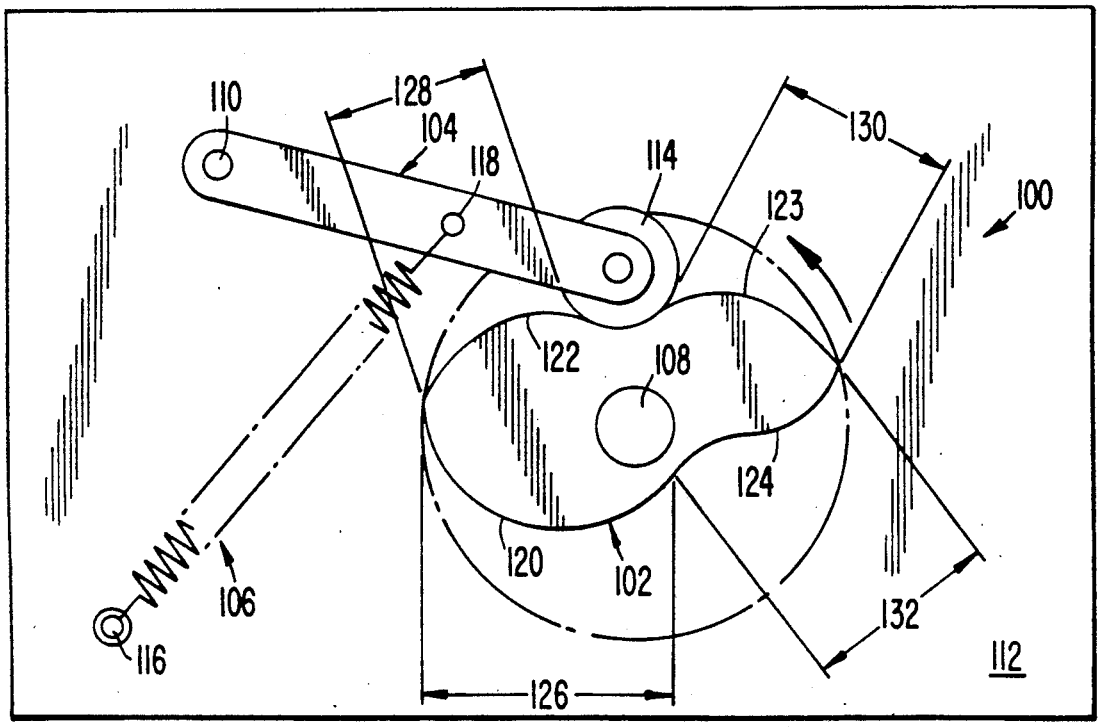
FIG. 8 is a view similar to FIG. 7 showing the drive assist assembly in another position.

The novel rotation drive assist mechanism for the feed roller 30 is best shown in FIGS. 1, 7 and 8 generally at 100. It is comprised of three basic components—a contoured cam shown generally at 102, a cam follower shown generally at 104, and a drive spring shown generally at 106. The contoured cam 102 is mounted on and keyed to the shaft 108 of the feed roller 30. The cam follower 104 is pivoted about a pin 110 on the side plate 112 of the dispenser chassis 10 and has a roller 114 rotatably attached at its opposite end. The roller 114 is adapted to ride on the contoured surface of the cam 102 and is urged into contact therewith by the drive spring 106, which is connected to the chassis side plate 112 at location 116 and attached under tension to the cam follower 104 at point 118.

The contoured cam 102 is designed so that, through the pressure exerted thereon by the drive spring 106 through the cam follower 104, it assists in the cutting of the web W during the portion of the cycle of the feed roller 30 wherein the knife or cutting blade 40 is being extended to cut the web and later drives the web out the dispenser exit 20. The contoured cam 102 has about its circumference, an initial spring cocking portion 120, a web cutting portion 122, a recocking portion 123, and an automatic feed portion 124. Another way of describing the contoured cam is by its quadrants as depicted in FIG. 8 by cocking quadrant 126, paper cutting assist quadrant 128, cocking (or recocking) quadrant 130, and feed out quadrant 132.

FIG. 7 shows the contoured cam 102 and cam follower 104 in position at the end of the automatic feed cycle. As the user pulls the exposed web WE, the feed roller 30 and cam 102 rotate counterclockwise as shown by the arrow. The initial spring cocking portion 120 of the cam thus rotates the cam follower 104 up to the position P as shown in broken dash and dot lines in FIG. 7. At this point the roller 114 begins to ride down the cam surface 122 under the tension of the drive spring 106 to help cut the web, until it reaches the position of FIG. 8 which corresponds to the roller-rotator position of FIG. 4. Further pull on the web causes the roller 114 to ride up the cam surface 123 to recock the drive spring 106 thereby returning the roller 114 to position P. At this point the roller rides down the steep surface of the automatic feed portion 124 to propel the web out the dispenser exit 20. Thus, the drive spring 106 is being cocked and recocked directly before and after the knife is extended and not during that portion of the cycle where considerable force is needed to sever the web. The drive spring 106 thereby supplies the needed varied torque to the cam 102 at every angular position of the cam 102. The cam 102 is contoured so that the force required to pull the web from the dispenser 10 remains fairly constant up to the point where the web is fed out automatically, thereby minimizing the needed pull on the web during the cutting portion of the cycle. In other words, the effort needed to pull a towel from the dispenser remains substantially uniform throughout the whole portion of the cycle where the towel is pulled from the dispenser. This is a significant improvement over the operation of prior dispensers.

Thus, this invention prevents the forces needed to cock the feed spring 106 and to cut the web W from occurring simultaneously. It also controls the forces acting on the towel web so that the pull needed by the user at any point during the extraction of the web is kept to a desirable minimum.

This contoured cam feedout arrangement or rotation drive assist mechanism 100 provides an easier and more reliably operable dispenser feedout. This difference is especially significant where softer creped paper is popular, as in the United States. For example, with the "Ultimatic" Dispenser having a close-coupled feedout spring, a pull of forty-four ounces during the end of the cut is required for a single ply and a pull of over five pounds is needed for double ply paper. In contrast, for the contoured feedout cam of the present invention, the maximum pull is reduced to thirty ounces for single ply paper and sixty ounces for double ply paper. In other words, the maximum drag with the close-coupled spring is about fifty percent greater than with the present cam-operated spring.

Figure 9A:
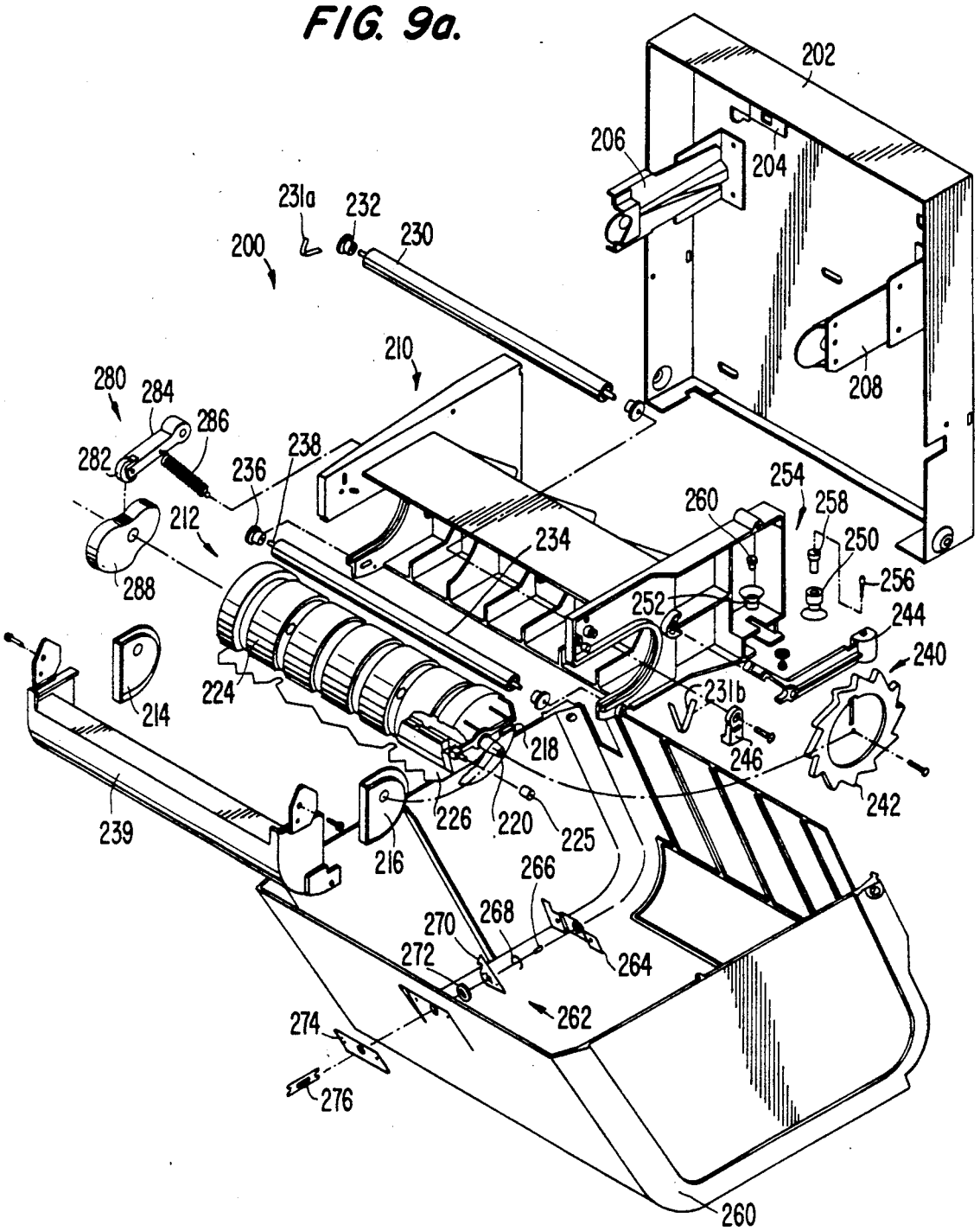
FIG. 9*a* is an exploded perspective view of a second dispenser utilizing a feed mechanism of the present invention.
Figure 12:
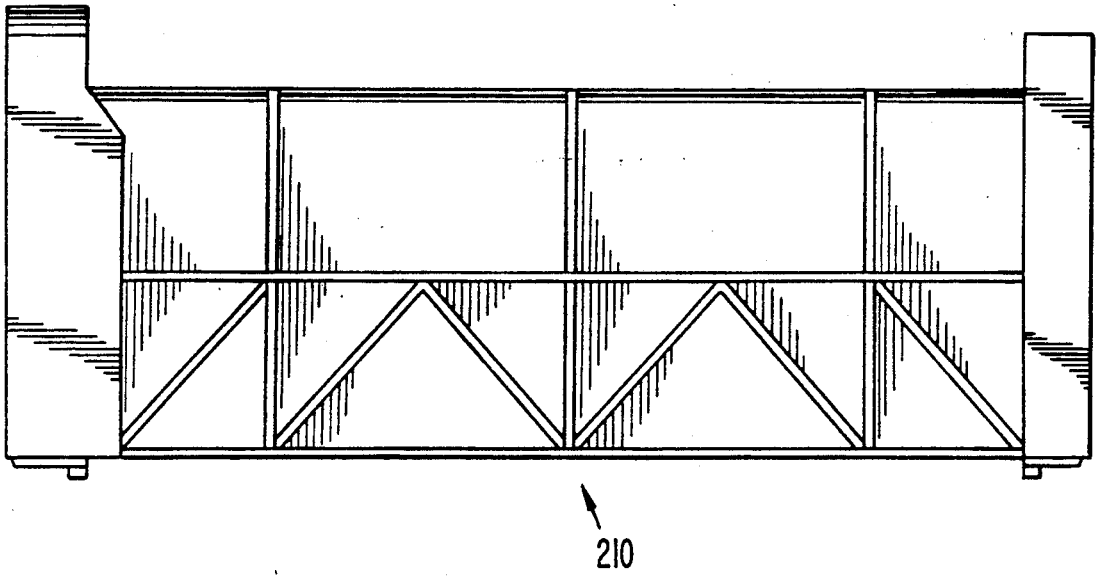
FIG. 12 is a rear elevational view of the housing of the dispenser of FIG. 9.
Figure 13:
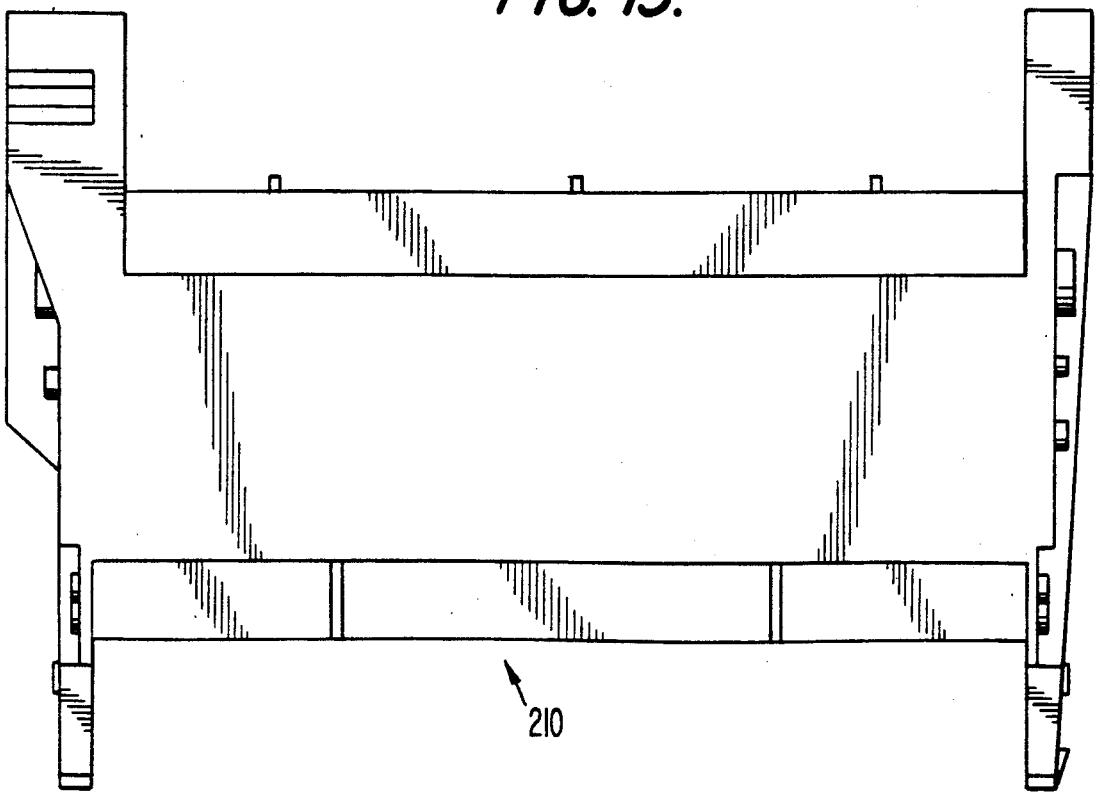
FIG. 13 is a bottom plan view of the housing of FIG. 9.
Figure 14:
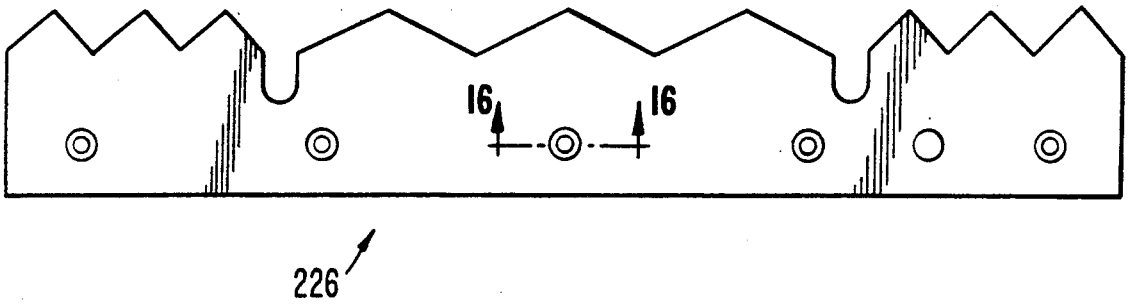
FIG. 14 is a top view of the knife of the dispenser of FIG. 9.
Figure 15:
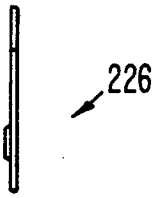
FIG. 15 is an end elevational view of the knife of FIG. 14.
Figure 16:
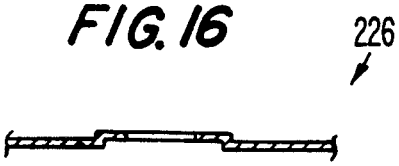
FIG. 16 is a cross-sectional view taken along line 16—16 of FIG. 14.

As is seen in FIG. 9*a*, a rolled material dispenser of a second embodiment of this invention is shown generally at 200. The dispenser 200 includes a back plate 202 mountable against a wall or other support surface so that the paper toweling or other webbed material therein is convenient for intending users. A strike plate 204 depends downwardly from the front of the top lip of the back plate 202. Welded or riveted roll mount assemblies 206, 208 are attached to the back plate 202 at upper inside locations to provide the rotatable support for the roll of web material (not shown in this drawing). A housing shown generally at 210, whose improved design provides greater stiffness and dimensional stability during the molding thereof, is secured to the back plate 202 at a lower location thereof. The housing 210 is shown in greater detail and in isolation in FIGS. 12 and 13. The feed roll shown generally at 212 is rotatably secured to and in the housing 210 by left and right cam chocks 214, 216. A front corner portion of the feed roll 212 is broken away to illustrate internal components thereof. The feed roll 212 includes a bottom roll 218, a top roll 220, feed roll tires 224, a pair of cam follower rollers 225 (see followers 62), and a carriage knife 226. The knife 226, which is shown in isolation and greater detail in FIGS. 14–16, is movable with respect to the feed roll tires 224 in a controlled cutting motion. The improved tooth configuration of the knife 226 makes for easier cutting of the web material from the roll. Details of the mounting and operating mechanism of cutting knives are disclosed, for example, in U.S. Pat. No. 4,712,461.

Figure 10:
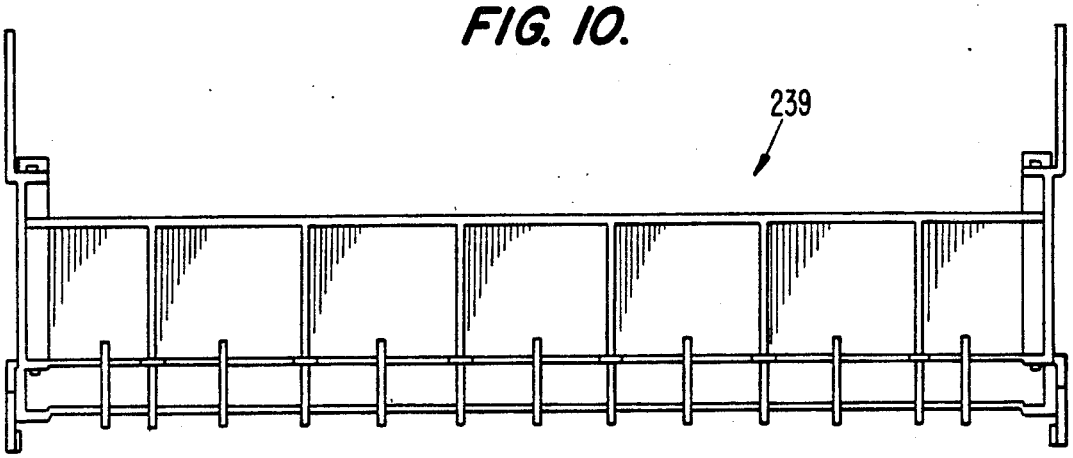
FIG. 10 is a rear elevational view of the stripper bar of the dispenser of FIG. 9.
Figure 11:
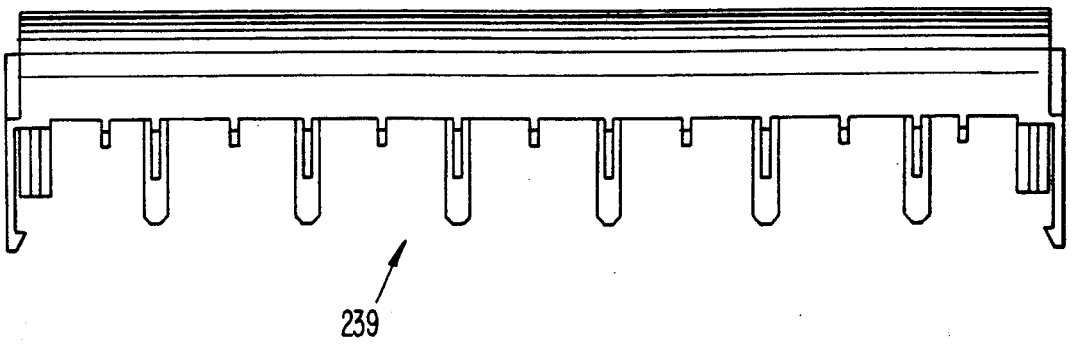
FIG. 11 is a bottom plan view of the stripper bar of FIG. 10.

An upper pinch roller 230 is attached via pinch roller bushings 232 and the web of material passes by the upper pinch roller, the feed roll 212 and then by the lower pinch roller 234, whose design effectively grips the web material thereby eliminating premature break-offs of the toweling material. The lower pinch roller 234 is similarly secured by lower pinch roller bushings 236 attached to the pinch roller shaft 238. Operation of exit or lower pinch rollers is described, for example, in the '155 application. Thus, the web withdrawn from the roll is threaded counterclockwise around an upper pinch roll 230 (which is biased upper pinch roller springs 231*a* and 231*b*), clockwise around the rear side of the feed roll 212, and counterclockwise over the exit pinch roll 234. A stripper bar 239 is securable to the housing 210 generally in front of the feed roll 212 and is illustrated in greater detail and in isolation in FIGS. 10 and 11.

A stop mechanism shown generally at 240 includes a feed wheel 242 driven by the towel web being pulled from the dispenser, a stop lever 244, and a pawl anti-reversing member 246. The stop mechanism 240 abruptly stops the rotation of the feed roll 212 so that individual sheets of paper toweling can be torn from the web along the perforations just made by the knife 226. The operation of dispenser feed wheels is explained further in U.S. Pat. No. 4,732,306. This stop mechanism design allows a positive stopping while absorbing kinetic energy, thereby greatly enhancing the life of the dispenser 200.

Upper and lower stationary and moving vacuum cups 250, 252 of a cup assembly shown generally at 254 and controlled by a needle valve 256 act as a stopping device which absorbs kinetic energy. The operation of a vacuum cup timing mechanism is shown, for example, in the '155 application. The '911 reissue patent discloses the use of vacuum cup timers to provide a time delay between the withdrawal of individual towel sheets to thereby reduce waste of the web material. The cup assembly 254 further includes a valve body mechanism 258 and a vacuum cup stud 260, as shown in FIG. 9*a*. The assembly 254 is associated with the stop mechanism 240 to regulate the length of time during which the stop mechanism is effective for preventing rotation of the feed roll 212. The needle valve 256 controls the flow of air into the vacuum environment between the vacuum cups 250, 252 to regulate the period of time during which the cups remain in a vacuum-gripping relationship, arresting further rotation of feed wheel 242 and the associated feed roll 212 with a spring-biased cam (as discussed later at 288). After the vacuum-gripping relationship has been destroyed by the entry of air between the cups 250, 252, the stop lever 244 releases the spring-biased cam, the feed roll tires 224, and the feed wheel 242.

With the roll of web material inserted and held in the roll mount assemblies 206, 208 and the free end of the material wound around the upper and lower pinch rollers 230, 234 and the feed roll 212, the cover 260 which is pivoted at the bottom to the back plate 202 is then pivoted upward to snap into place, protecting the internal components of the dispenser. The locking assembly for locking the cover 260 in its closed position relative to the back plate 202 is shown generally at 262, and includes a plate lock 264, a stud lock 266, a spring lock 268, a hammer lock 270, a lock barrel 272, a lock plate 274, and a key 276.

Figure 9B:
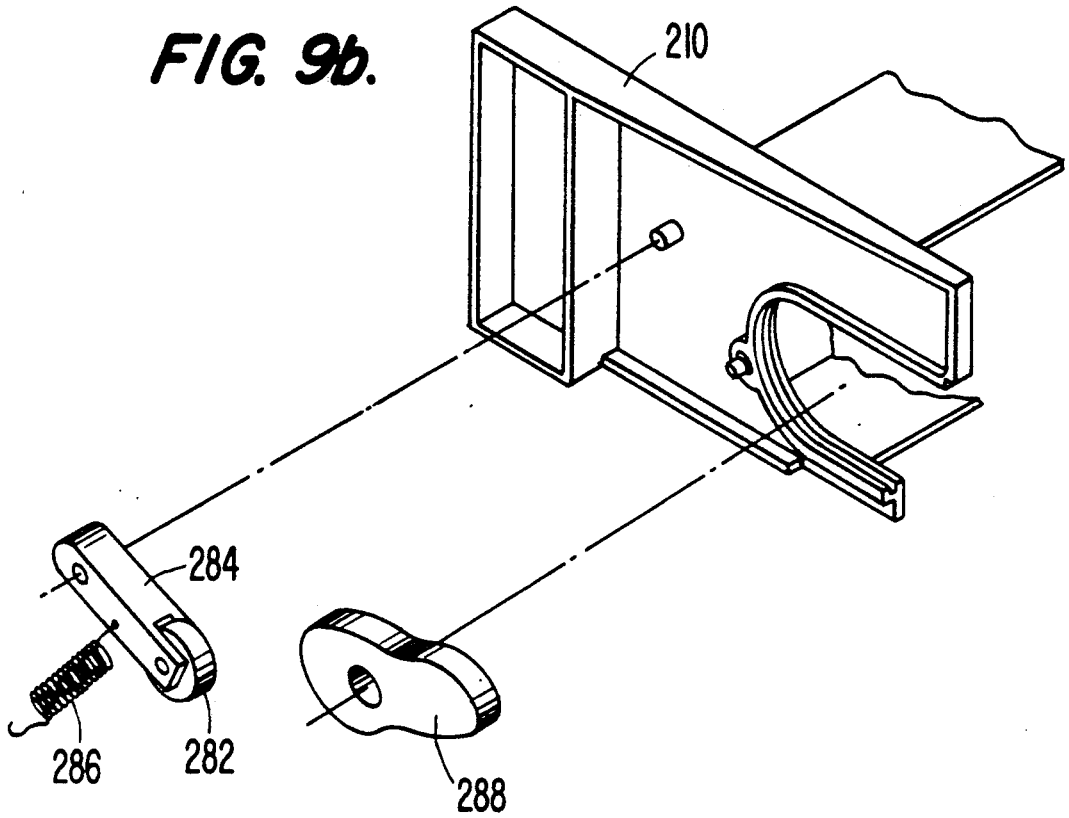
FIG. 9*b* is an exploded perspective view of an end portion of the housing of the dispenser of FIG. 9*a*.

A drive rotation assist for the feed roll 212 is shown in exploded view in FIGS. 9*a* and 9*b* generally at 280 and includes a cam follower 282, a cam follower arm 284, an extension spring 286, and the previously-mentioned cam 288. This contoured cam feedout type of assist 280 controls the movement of the feed roll 212 as in the first-described dispenser embodiment of this invention. In summary, the assist 280 is loaded as the mechanism is rotated. As soon as the stop mechanism releases, the cam actuates the feedout of the web material. About thirty percent of the stored energy is released to assist with the cutting of the web and the remaining larger portion of energy is then released to feed the web out of the dispenser. The stored force is thereby advantageously controllably released to help with cutting as well as feed out of the web material.

From the foregoing detailed description, it will be evident that there are a number of changes, adaptations and modifications of the present invention which come within the province of those persons having ordinary skill in the art to which the aforementioned invention pertains. However, it is intended that all such variations not departing from the spirit of the invention be considered as within the scope thereof as limited solely by the appended claims.

What is claimed is:

1. A method of dispensing a web of flexible sheet material from a dispenser including a feed roller rotatable through an operating cycle that includes a web cutting segment and a lead feed segment, a cam operably connected to said feed roller, a cam follower operable with said cam, and a drive spring tensionably attached to said cam follower, the method comprising the steps of:

storing energy in said drive spring by rotating said feed roller through that portion of its operating cycle occurring prior to completion of said web cutting segment;

releasing at least a portion of the energy stored in said drive spring to assist rotation of said feed roller in cutting said web during the web cutting segment of said operating cycle;

thereafter storing energy in said drive spring during rotation of said feed roller following completion of said web cutting segment; and releasing energy stored in the drive spring to assist in rotation of said feed roller during the lead feed segment of said cycle, such that a lead of said flexible sheet material is fed from said dispenser for access by a subsequent user.

2. A feed mechanism for a dispenser, comprising:

feed roller means for guiding a web of sheet material from a material storage position to a user accessible position relative to a dispenser, said feed roller means being rotatable through a cycle having a web cutting cycle segment and a lead feed cycle segment after said web cutting cycle segment and during which a lead of the remaining web material is fed out generally away from the dispenser;

a cutter blade operatively associated with said feed roller means and positioned to cut the web during said web cutting cycle segment; and energy storage means containing means for cocking and releasing stored energy to said feed roller initially during said web cutting cycle segment and for subsequently cocking and releasing stored energy to said feed roller during said lead feed segment.

3. The feed mechanism of claim 2 wherein said energy storage means is cocked to store energy as a user pulls on the web during said cycle before said web cutting cycle segment and before said lead feed cycle segment.

4. The feed mechanism of claim 2 wherein said feed roller means includes a feed roll having a feed roll slot, said cutter blade is positioned within said feed roll, and said cutter blade is projectable and retractable through said feed roll slot.

5. The feed mechanism of claim 4 wherein said cutting blade includes a cutting edge, and further comprising projecting means for projecting said cutting edge, with the rotation of said feed roller means, beyond the periphery of said feed roller means to cut the web during said web cutting cycle segment and for subsequently retracting said cutting edge relative to said periphery.

6. The feed mechanism of claim 5 wherein said stored energy cocking and releasing means comprises a drive spring means operative for storing and for releasing energy, initially to assist in the cutting cycle segment and subsequently to assist in propelling the web out of the dispenser during the lead feed cycle segment.

7. The feed mechanism of claim 6 wherein said drive spring means comprises a contoured cam attached to and rotatable with said feed roller means, an angularly deflectable cam follower, and a drive spring attached under tension to said cam follower and biasing said cam follower against said contoured cam throughout the entire rotation cycle of said feed roller means.

8. The feed mechanism of claim 2 wherein said energy storing means includes a cam attached to and rotatable with said feed roller means, an angularly defectable cam follower, and a drive spring tensionably attached to said cam follower and pressing said cam follower against said contoured cam, said cam having a camming surface about its periphery cooperable with said cam follower and said spring for cocking and releasing stored energy to said feed roller during said web cutting and said lead feed cycle segments respectively.

9. A feed mechanism for a dispenser, comprising:

a rotatable feed roller adapted to controllably feed a flexible sheet material web out of a dispenser, said feed roller having a feed roller periphery;

a cutter slidably mounted within said feed roller, said cutter having a cutter edge projecting beyond said feed roller periphery during a flexible sheet material web cutting cycle portion of a rotation cycle of said feed roller and thereafter retracting into said feed roller;

a spring associated with said feed roller;

first cocking means for cocking said spring and subsequently unloading said spring and thereby assisting the rotation of said feed roller during the web cutting cycle portion; and second cocking means for cocking said spring directly after said web cutting cycle portion and subsequently unloading said spring and thereby assisting the further rotation of said feed roller to feed a lead of the flexible sheet material web out of the dispenser and accessible to the next user.

10. The feed mechanism of claim 9 wherein said first and second cocking means define a cocking assembly, said cocking assembly includes a contoured cam attached to and rotatable with said feed roller and a cam follower, and said spring drivingly biases said cam follower against said contoured cam.

11. The feed mechanism of claim 10 wherein said contoured cam has different first and second cam profiles, said first cocking means includes said first cam profile, and said second cocking means includes said second cam profile.

12. An apparatus for dispensing a web of flexible sheet material, comprising:

feed roller means for feeding a web of flexible sheet material generally out of a dispenser;

severing means for cutting a portion of the web during one cycle segment of rotation of the feed roller means;

a cam element attached to said feed roller means and rotatable therewith;

drive spring means for storing energy a first time to assist in a cutting cycle segment of said feed roller means and a second time to assist in propelling the web out of the dispenser during a lead feed cycle segment of said feed roller means; and cam follower means for loading and releasing said drive spring means.

13. The apparatus of claim 12 wherein said cam follower means includes a roller and a tension spring biasing said roller against said cam element during the entire rotation cycle of said feed roller means.

14. The apparatus of claim 13 wherein said cam element is a double contoured cam having first and second differently contoured cam portions.

15. The apparatus of claim 14 wherein said first cam portion is for cocking said spring to assist in the rotation of said feed roller during the web cutting cycle segment and said second cam portion is for cocking said spring to assist in the further rotation of said feed roller means to feed a lead of the flexible sheet material web out of the dispenser and accessible to a next user.

* * * * *

UNITED STATES PATENT AND TRADEMARK OFFICE

CERTIFICATE OF CORRECTION

PATENT NO. : 5,048,386

DATED : September 17, 1991

INVENTOR(S) : Raymond DeLuca, et al.

It is certified that error appears in the above-identified patent and that said Letters Patent is hereby corrected as shown below:

Column 11, line 45, "5" should read -- 2 --; and

Column 11, line 60, "defect-" should read -- deflect- --.

Signed and Sealed this

Ninth Day of March, 1993

*Attest:*

STEPHEN G. KUNIN

*Attesting Officer*

*Acting Commissioner of Patents and Trademarks*